US009576566B2

(12) United States Patent
Senften

(10) Patent No.: US 9,576,566 B2
(45) Date of Patent: Feb. 21, 2017

(54) ELECTRONIC BASS MUSICAL INSTRUMENT

(76) Inventor: David Senften, St. Charles, MO (US)

( * ) Notice: Subject to any disclaimer, the term of this patent is extended or adjusted under 35 U.S.C. 154(b) by 900 days.

(21) Appl. No.: 13/280,648

(22) Filed: Oct. 25, 2011

(65) Prior Publication Data

US 2013/0098229 A1 Apr. 25, 2013

(51) Int. Cl.

| | |
|---|---|
| ***G10H 3/00*** | (2006.01) |
| ***G10H 1/38*** | (2006.01) |
| ***G10H 1/34*** | (2006.01) |

(52) U.S. Cl.

CPC ..... *G10H 1/386* (2013.01); *G10H 1/342* (2013.01); *G10H 2230/085* (2013.01)

(58) Field of Classification Search

CPC ..... G10H 1/342; G10H 1/0066; G10H 3/18; G10H 2220/096; G10H 2220/301; G10H 1/34; G10H 1/38; G10H 1/0558; G10H 2220/241; G10H 3/181; G10H 1/0016; G10H 2220/361; G10H 2220/561; G10H 3/00; G10H 3/182; G10H 3/185; G10H 1/28

See application file for complete search history.

(56) References Cited

U.S. PATENT DOCUMENTS

| | | | | |
|---|---|---|---|---|
| 1,679,834 | A | 8/1928 | Lentz | |
| 2,033,826 | A | 3/1936 | Haium | |
| 2,168,736 | A | 8/1939 | Jones | |
| 2,861,494 | A | 11/1958 | Guthrie | |
| 3,318,181 | A | 5/1967 | Benner | |
| 3,680,423 | A | 8/1972 | Lander | |
| 3,774,492 | A | 11/1973 | Forbes | |
| 3,913,441 | A | 10/1975 | Manor | |
| 5,040,447 | A * | 8/1991 | Murata et al. | 84/612 |
| 5,121,668 | A * | 6/1992 | Segan et al. | 84/646 |
| 5,227,575 | A * | 7/1993 | Mishima | 84/670 |
| 5,293,804 | A * | 3/1994 | Myers | 84/291 |
| 5,398,585 | A * | 3/1995 | Starr | 84/646 |
| 5,557,057 | A * | 9/1996 | Starr | 84/617 |
| 5,777,251 | A * | 7/1998 | Hotta et al. | 84/609 |
| 6,005,173 | A * | 12/1999 | Mitchell | 84/291 |
| 6,018,119 | A * | 1/2000 | Mladek | 84/722 |
| 6,162,981 | A * | 12/2000 | Newcomer et al. | 84/485 R |
| 6,753,466 | B1 * | 6/2004 | Lee | 84/669 |
| 7,220,906 | B2 * | 5/2007 | Sasaki | 84/464 A |
| 7,230,175 | B2 * | 6/2007 | Whiteside | 84/465 |
| 7,304,224 | B1 * | 12/2007 | Bettis et al. | 84/293 |
| 7,417,185 | B2 * | 8/2008 | Ludwig | 84/379 |
| 7,465,870 | B1 * | 12/2008 | Homan | 84/743 |
| 7,598,449 | B2 * | 10/2009 | Sullivan | 84/646 |
| 7,897,866 | B2 * | 3/2011 | Sullivan | 84/724 |
| 7,973,234 | B1 * | 7/2011 | Yang et al. | 84/743 |
| 8,003,872 | B2 * | 8/2011 | Lopiccolo et al. | 84/609 |

(Continued)

*Primary Examiner* — Marlon Fletcher
(74) *Attorney, Agent, or Firm* — Joseph M. Rolnicki; Evans & Dixon, L.L.C.

(57) ABSTRACT

An electronic bass musical instrument that has the appearance, character and ambiance of a traditional washtub bass where the sounds of the bass are produced electronically by manually pressing an electrically conductive string extending along a neck of the bass against selected electrically conductive contacts arranged at spaced positions along the neck thus sending signals to an electronic control circuit of the instrument, whereby the sounds of the bass are produced electronically, providing vastly improved tonal quality and pitch accuracy to the sounds produced.

16 Claims, 6 Drawing Sheets

(56) References Cited

U.S. PATENT DOCUMENTS

| | | | | |
|---|---|---|---|---|
| 8,079,901 | B2 * | 12/2011 | Brosius et al. | 463/7 |
| 2005/0109196 | A1 * | 5/2005 | Whiteside | 84/722 |
| 2006/0123971 | A1 * | 6/2006 | Moghaddam | 84/290 |
| 2007/0234885 | A1 * | 10/2007 | Schmidt et al. | 84/722 |
| 2008/0028920 | A1 * | 2/2008 | Sullivan | 84/722 |
| 2011/0308378 | A1 * | 12/2011 | Wallace et al. | 84/689 |
| 2012/0137859 | A1 * | 6/2012 | Degerland | 84/731 |

* cited by examiner

ELECTRONIC BASS MUSICAL INSTRUMENT

BACKGROUND OF THE INVENTION (1) Field of the Invention

The present invention pertains to an electronic bass musical instrument. More specifically, the present invention pertains to an electronic washtub bass musical instrument having the appearance, character and ambiance of a traditional washtub bass where the sounds of the bass are produced electronically, thereby providing vastly improved tonal quality and pitch accuracy to the sounds produced.

(2) Description of the Related Art

The washtub bass, or "gutbucket," is a stringed instrument used in American folk music that uses a metal washtub as a resonator. The traditional washtub bass is comprised of an inverted metal washtub, an elongate staff or stick held by the bass player in an upright orientation on top of the inverted washtub, and a single string that is secured to the top of the staff or stick and the center of the inverted washtub bottom. The pitch of the single string is adjusted by the bass player by pushing or pulling on the staff or stick to change the tension in the string.

The washtub bass was used in jug bands that were popular in some African American communities in the early 1900s. In the 1950s, U.S. folk musicians used the washtub bass in jug band-influenced music.

The hallmarks of the traditional washtub bass design are simplicity, very low costs and do-it-yourself construction. However, these gave the traditional washtub bass its historical reputation for poor tonal quality and difficult, if not impossible pitch control.

SUMMARY OF THE INVENTION

When a right-handed bassist plays a standard acoustic string bass instrument, the left hand of the bassist manipulates the strings at the upper end of the instrument fingerboard to provide the proper pitch while the right hand of the bassist either plucks, slaps, bows or otherwise causes the strings to vibrate to produce the sounds intended. With a traditional washtub bass, the left hand of the bassist applies a variable tension to the upper end of the single string of the instrument by pushing or pulling on the staff or stick to change the tension in the string to produce the proper pitch when the string is plucked by the bassist's right hand.

The electronic bass musical instrument of the invention utilizes the traditional hand positions of both instruments by providing electrical input devices at those positions that send signals to electronic sound producing control circuitry of the invention that in turn produces the desired sounds from an appropriate amplifier system.

The electronic bass musical instrument of the invention also employs an inverted washtub for form and structure but not as a resonator. A brace member is attached to a sidewall of the washtub. A neck with a fingerboard surface extends upwardly from the brace member. Together the inverted washtub and the brace member form a support for the neck.

A first plurality or first set of electrically conductive contacts are mounted on the upper end of the fingerboard surface. The contacts are positioned directly under a metallic electrically conductive string that extends the length of the fingerboard and enters the center of the inverted washtub. The string is spaced a small distance from the contacts by frets positioned between adjacent contacts. The contacts are electrically connected to electronic sound producing control circuitry located inside the washtub by wires extending from each of the contacts, through the neck, through the brace member and into the washtub where they communicate with the electronic sound producing control circuitry. The metallic string passes through the bottom surface of the inverted washtub and is connected to the ground of the electronic sound producing control circuitry. The plurality of electrically conductive contacts on the neck fingerboard and the metallic electrically conductive string form a plurality of switches that, when the string is pressed against one of the contacts by the bassist the switch is closed, thereby providing a specific input signal to the electronic sound producing control circuitry in the washtub that establishes the pitch of the notes to be played.

A second plurality or second set of electrically conductive contacts is also provided on the instrument neck fingerboard. The second plurality of contacts is located lower on the fingerboard than the first plurality of contacts where the bassist would normally pluck the string. Pressing the string against any of the second contacts operatively produces switch closures that signal the electronic control circuitry in the washtub to sound a particular note. Isolating frets are also provided in this area of the fingerboard between adjacent contacts. These frets establish the appropriate spacing between the metallic string and the contacts and also serve to prevent unintended multiple switch closures of the adjacent contacts.

In playing the electronic bass musical instrument, the key in which a composition is to be played is selected by a switch on the sidewall of the inverted washtub. The switch communicates with the electronic sound producing control circuitry inside the washtub and provides an appropriate selection code to the control circuitry inside the washtub. The desired chord is selected by the bassist pressing the string against an appropriate contact of the first set of contacts at the upper end of the fingerboard. The desired note is then played by the bassist pressing the string against the appropriate contact of the second set of contacts at the lower end of the fingerboard.

DESCRIPTION OF THE DRAWING FIGURE

Further features of the electronic bass musical instrument of the invention are set forth in the following detailed description of the instrument and in the drawing figures.

DETAILED DESCRIPTION OF THE INVENTION

Figure 1:
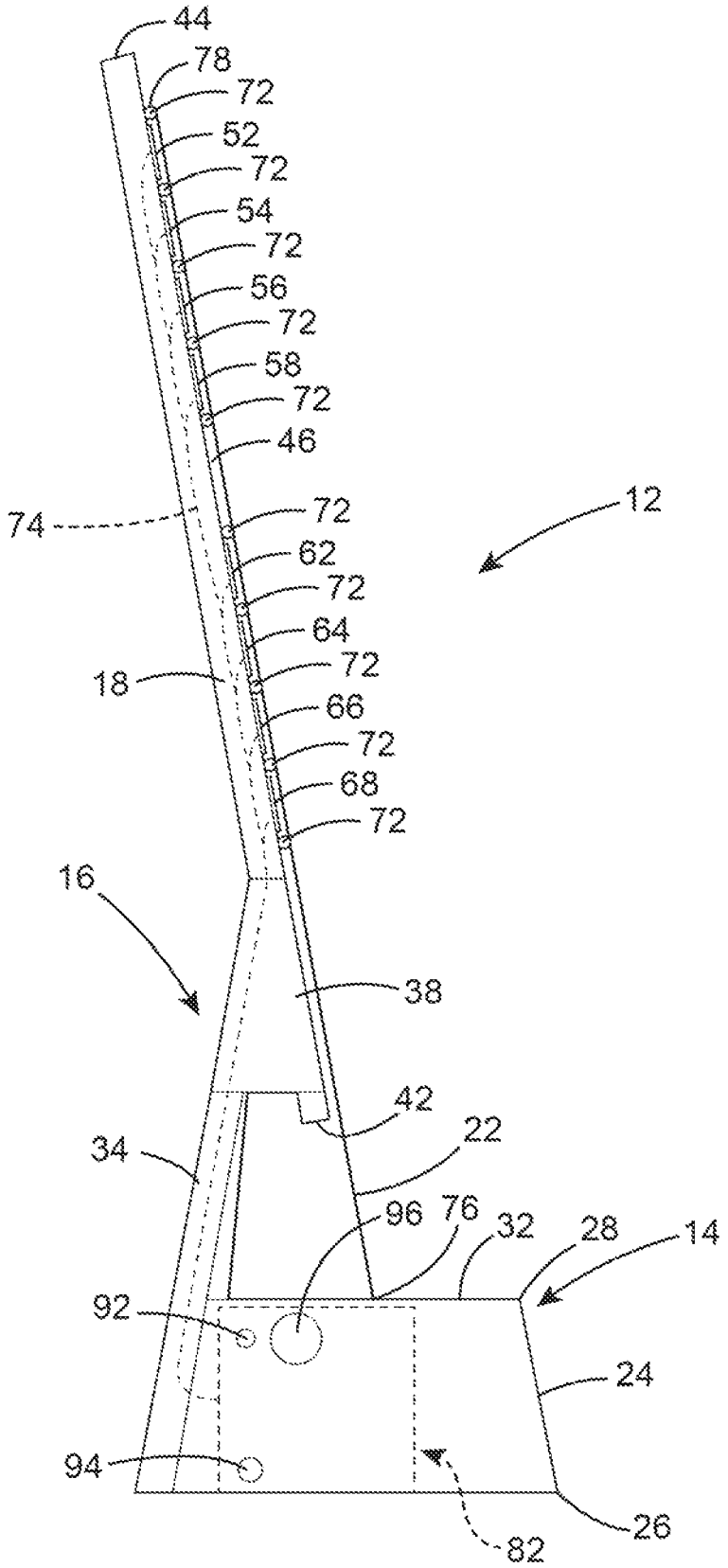
FIG. 1 is a side elevation view of the electronic bass musical instrument of the invention.
Figure 2:
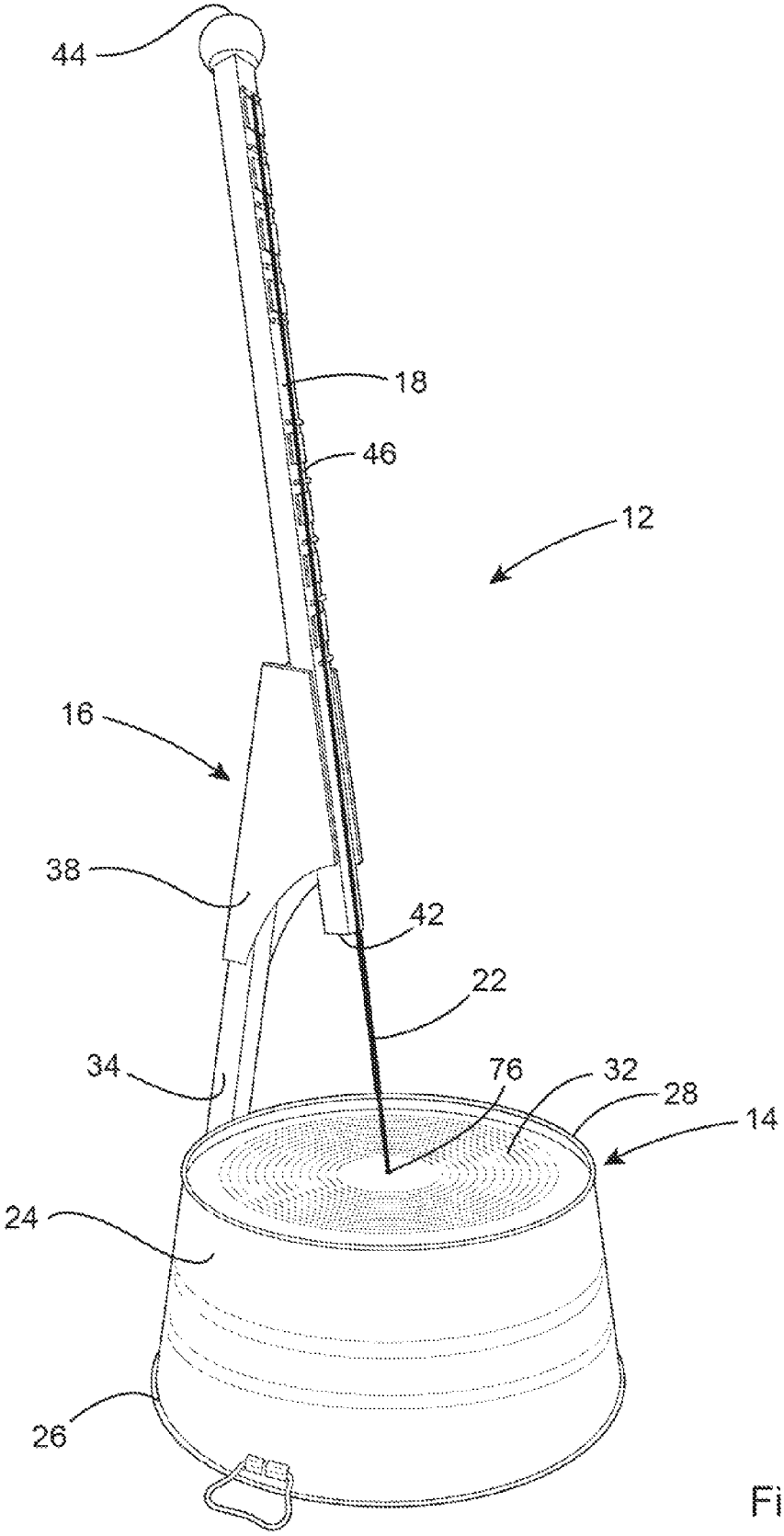
FIG. 2 is a perspective view of the musical instrument.
Figure 3:
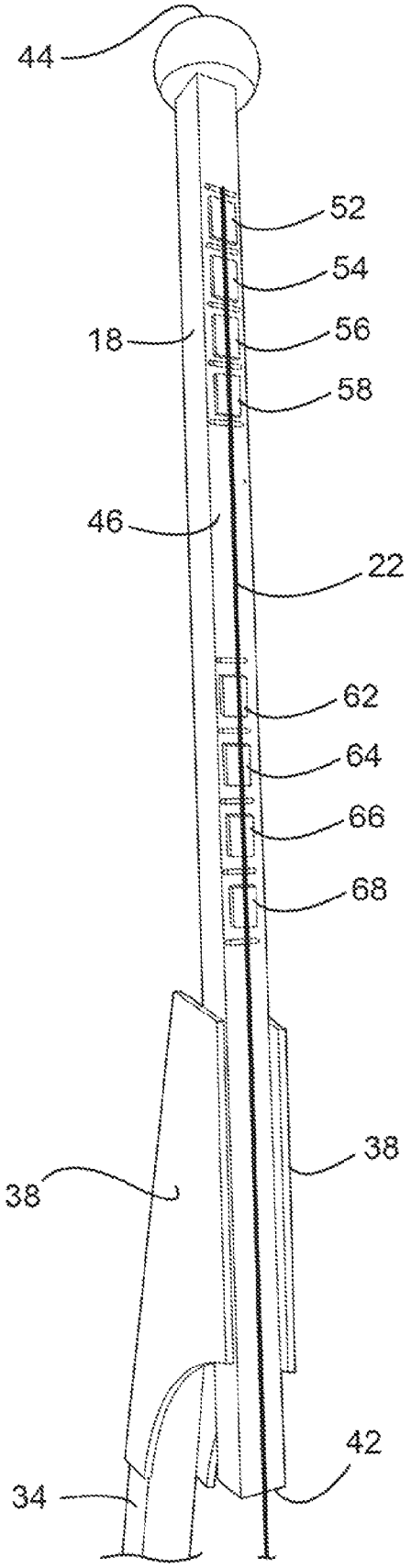
FIG. 3 is a side view of a portion of the instrument neck.
Figure 4:
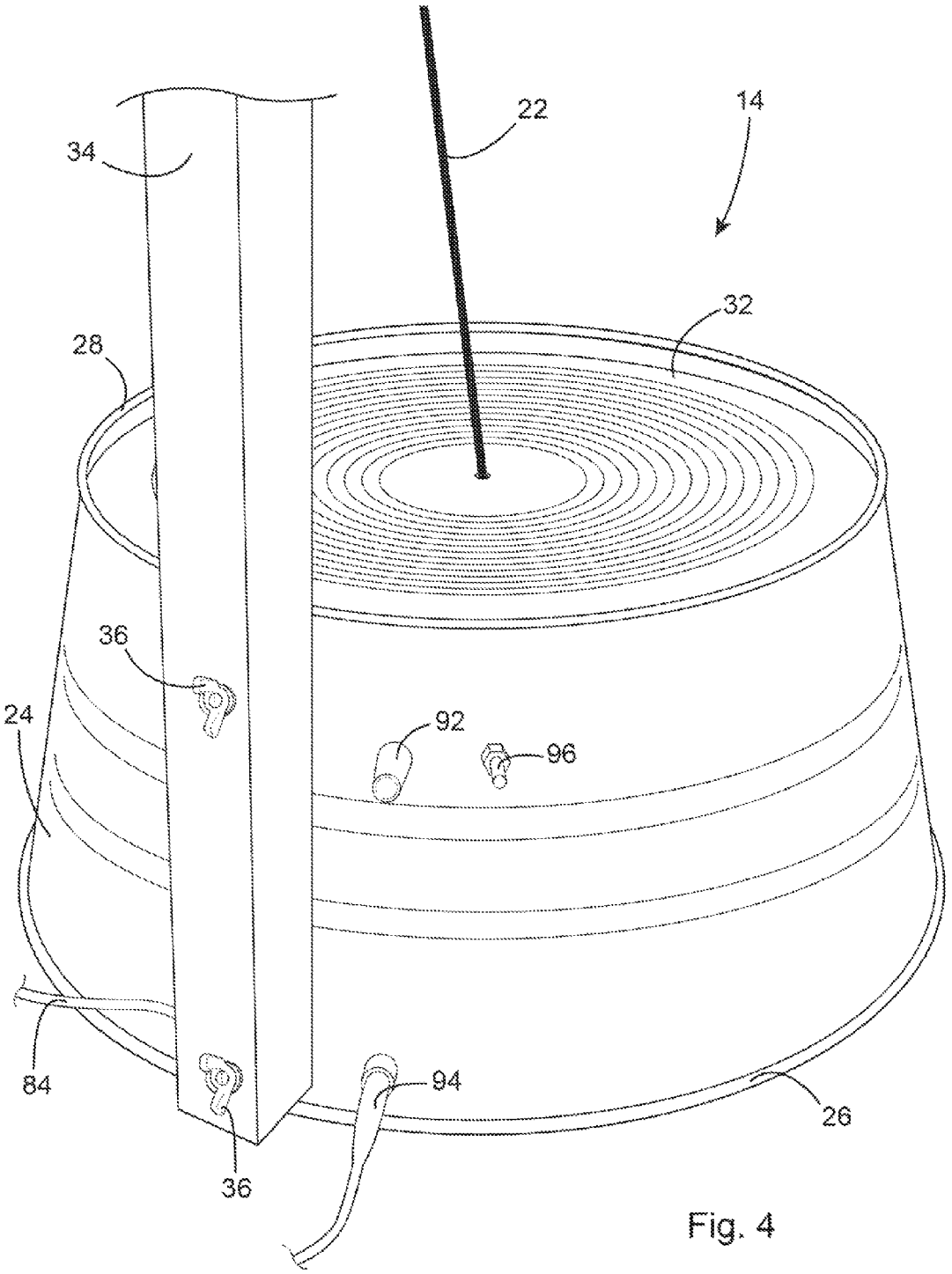
FIG. 4 is a perspective view of the inverted washtub of the instrument.

The electronic bass musical instrument 12 of the invention is basically comprised of a washtub 14, a brace member 16, a neck 18 and a string 22. In the embodiment of the invention to be described the basic component parts of the instrument set forth above are constructed of materials typically used in the construction of a traditional washtub bass. For example, the washtub 14 is constructed of galvanized steel, the brace member 16 and neck 18 are constructed of wood, and the string 22 is a metallic electrically conductive string. These materials give the electronic bass musical instrument of the invention the general appearance of a traditional washtub bass. However, it should be understood that other equivalent types of materials may be employed in constructing the electronic bass musical instrument of the invention.

The washtub 14 has the basic configuration of an inverted washtub. The washtub 14 has a sidewall 24 that extends completely around the washtub. The sidewall 24 has a bottom circular rim 26 and a top circular rim 28. The diameter dimension of the bottom circular rim 26 is larger than that of the top circular rim 28, thereby giving the sidewall 24 a configuration of a truncated cone. A circular top surface 32 is secured to the sidewall top rim 28 around the periphery of the top surface. If the washtub 14 were not inverted, the washtub top surface 32 could actually be the bottom surface or bottom wall of the washtub and the washtub bottom rim 26 and top rim 28 would actually be the respective top rim and bottom rim of the washtub.

The brace member 16 is attached to the washtub sidewall 24. In the embodiment shown in the drawing figures, the brace member 16 includes a straight column 34 having a rectangular cross section that is secured by a pair of removable mechanical fasteners 36 to the washtub sidewall 24. In the embodiment shown in the drawing figures, screw threaded bolts and wing nuts are employed as the mechanical fasteners 36. Also in the embodiment shown, the column 34 is constructed from a 2×2 piece of wood. However, as stated earlier, other equivalent materials may be employed. The brace member 16 also includes a pair of generally triangular gusset panels 38 secured to the opposite sides of the column 34 toward the top of the column. The gusset panels 38 are also constructed of wood, although other equivalent materials may be used. The gusset panels 38 are secured to the opposite sides of the column 34 by mechanical fasteners, adhesives or other equivalent means.

The bottom portion of the neck 18 engages against a top end of the brace member column 34 and extends between the gusset panels 38 to a proximal end 42 of the neck. In the embodiment of the instrument shown in the drawing figures, the neck 18 is an elongate shaft of wood having a rectangular cross section and a straight configuration that extends between the proximal end 42 of the neck and a distal end 44 of the neck. In the embodiment of the instrument shown in the drawing figures, the neck 18 is constructed from a 2×2 piece of wood, although other materials may be employed. The bottom portion of the neck 18 is secured to the top of the support column 34 and between the pair of gusset panels 38 by mechanical fasteners, adhesives or other equivalent means. Together, the inverted washtub 14 and the brace member 16 form a support for the neck 18. A front surface of the neck 18 that faces away from the brace member column 34 and gusset panels 38 functions as the fingerboard 46 of the neck 18. In contrast to the traditional bass where the shaft or stick of the bass is movable, the neck 18 is held stationary relative to the washtub 14 by the brace member column 34 and gusset panels 38. However, for ease of transportation and storage, the mechanical fasteners 36 connecting the brace member column 34 to the washtub sidewall 24 can be easily removed, enabling the brace member column 34, the gusset panels 38 and the neck 18 to be removed as one piece from the washtub 14.

A first plurality of sensors or first set of electrically conductive contacts or plates 52, 54, 56, 58 are attached to the front surface or fingerboard 46 of the neck 18. As seen in the drawing figures, the first set of contacts 52, 54, 56, 58 are attached to the neck fingerboard 46 at spaced positions along the length of the neck 18 and toward the distal end 44 of the neck. A second plurality of sensors or second set of electrically conductive contacts or plates 62, 64, 66, 68 are also attached to the front surface or fingerboard 46 of the neck 18. The second set of contacts 62, 64, 66, 68 are arranged at spaced positions along the length of the neck 18 toward the proximal end 42 of the neck. The first set of contacts 52, 54, 56, 58 are positioned on the neck fingerboard 46 where the left hand of a right-handed bassist would hold the neck 18. The second set of contacts 62, 64, 66, 68 are positioned on the neck fingerboard 46 where the right hand of a right-handed bassist would typically pluck, slap, bow or otherwise cause the strings of a conventional bass to produce the sounds intended. The first set of electrically conductive contacts 52, 54, 56, 58 and the second set of electrically conductive contacts 62, 64, 66, 68 are separated from each other by isolating frets 72. The frets extend along the width of the neck fingerboard 46 with a pair of frets 72 being positioned above and below each of the electrically conductive contacts. Each of the electrically conductive contacts 52, 54, 56, 58, 62, 64, 66, 68 is electrically connected to a separate electrical conductor 74 that extends through the interior of the neck 18 and the bass column 34 to the interior of the washtub 14. In order to simplify the drawing figures, each of the separate electrical conductors 74 connected to each one of the electrical conductive contacts 52, 54, 56, 58, 62, 64, 66, 68 is represented as a single-line extending through the neck 18 and the brace member column 34 to the interior of the washtub 14.

The string 22 has a elongate length with opposite proximal 76 and distal 78 ends. In the embodiment shown in the drawing figures, the string 22 is a metallic electrically conductive string. However, other electrically conductive materials may be employed. The string distal end 78 is secured to the neck front surface 46 adjacent the neck distal end 44. The string proximal end 76 passes through a hole at the center of the washtub top surface 32 and into the interior of the washtub 14. The string 22 is secured to the washtub top surface 32 so that the length of the string extends taut from the washtub top surface 32 over the second set of electrically conductive contacts 62, 64, 66, 68 and then over the first set of electrically conductive contacts 52, 54, 56, 58 to the string distal end 78. The plurality of frets 72 on the neck front surface 46 prevent the string 22 from contacting any of the electrically conductive contacts 52, 54, 56, 58, 62, 64, 66, 68 but allow a portion of the string 22 to be manually pressed between a pair of adjacent frets 72 and make contact with one of the electrically conductive contacts, thereby closing a switch between the string and the contact.

Figure 5:
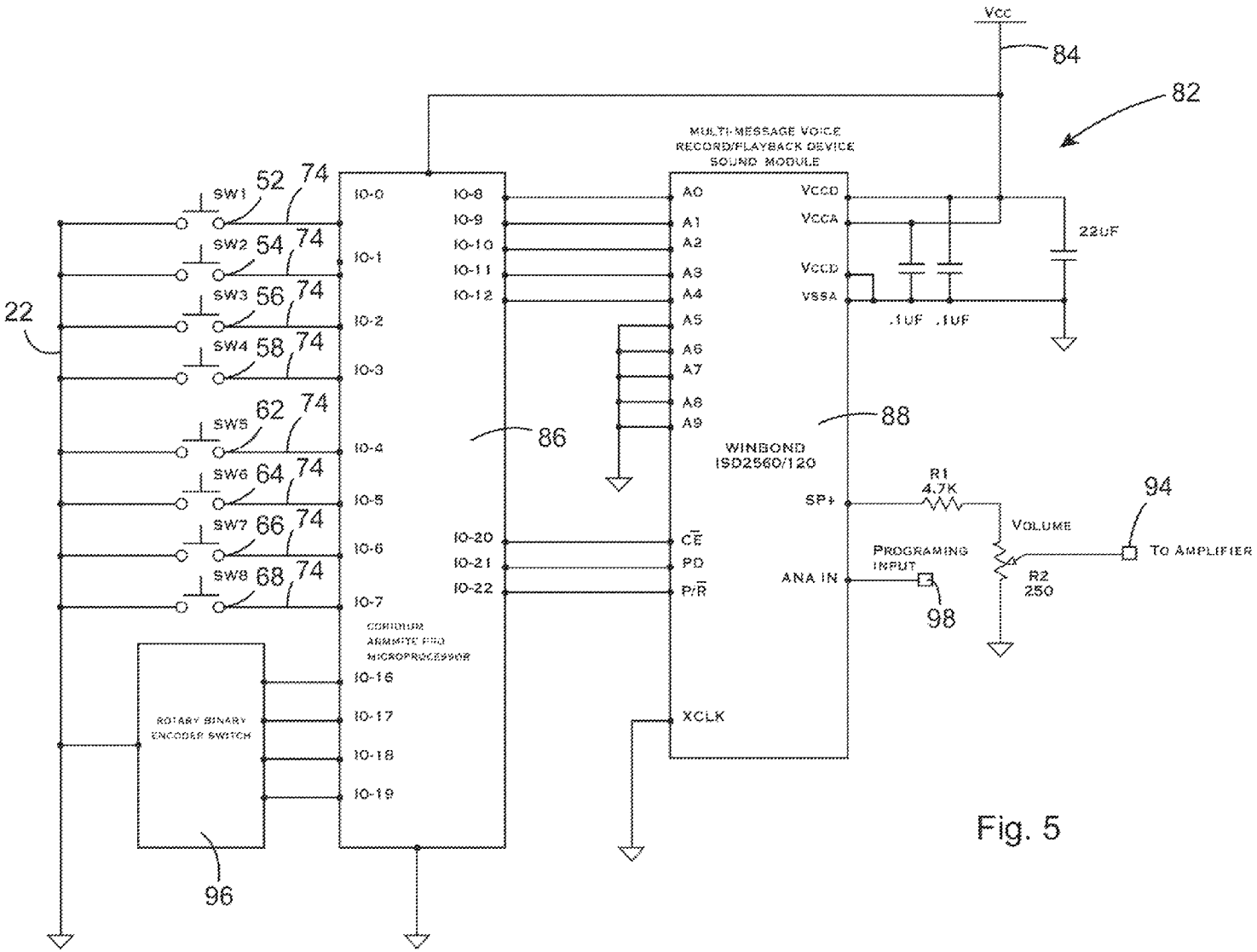
FIG. 5 is a schematic representation of the electronic sound producing control circuitry of the instrument.

Electronic sound producing control circuitry 82 is contained in and supported by the washtub 14. In other embodiments, the circuitry could be separate from the washtub and remote from the instrument. The circuitry 82 contained in the washtub 14 is represented by dashed lines in FIG. 1. The circuitry 82 can incorporate any of a number of well known techniques including analog, digital or a microprocessor that provide tone generation or record/replay strategies responsive to input signals received by the control circuitry that are created by closing the switches of the electrically conductive contacts 52, 54, 56, 58, 62, 64, 66, 68. FIG. 5 provides a schematic representation of one example of the electronic sound producing control circuitry 82. The circuitry receives power from a conventional plug-in power supply unit (not shown) through a cord 84 that extends from the circuitry and the washtub to the power supply unit that can be plugged into an AC wall outlet. In the circuitry 82 of FIG. 5, signals produced by closing the switches of the electrical contacts 52, 54, 56, 58, 62, 64, 66, 68 are received by the circuitry 82 and processed by a microprocessor 86 which then sends signals to a sound module 88 to produce the audio signals wanted. The audio signals produced by the sound module are sent to an external amplifier system through a volume control 92 and an output jack 94 on the washtub 14.

It is well understood in music theory that there are three principal chords specific to each key in which musical compositions are played. For example in the key of "C," the principal chords are "C," "F," and "G7." There are also specific relative minor chords for each key, which for the key of "C" are "Am," "Dm," and "E7." There are alternative chords as well. In each chord in each key there are certain individual notes that are most generally played by a plucked string bass. In this instrument 12 the key in which a composition is to be played is selected by a rotary binary encoder switch 96. The switch 96 provides an appropriate selection code to the electronic sound producing control circuitry 82. The desired chord is selected by pressing the string 22 against an appropriate one of the first set of electrically conductive contacts 52, 54, 56, 58. Then, the desired note is played by pressing the string 22 against an appropriate one of the second set of electrically conductive contacts 62, 64, 66, 68.

In operation of the electronic bass musical instrument 12, a musician manually sets the rotary binary encoder switch 96 on the washtub sidewall 24 to provide a binary coded input to the microprocessor inputs IO-16, IO-17, IO-18, IO-19 that inform the microprocessor 86 of which of the twelve major keys in which the musician wants to play. In the example of the electronic sound producing control circuitry 82 shown in FIG. 5, the microprocessor 86 is an ARMmite PRO single board programmable controller provided by Coridium Corporation. Other equivalent types of microprocessors could be used.

The musician then selects one of the three principal chords or a relative minor chord consistent with the key selection made by the binary encoder switch 96. The desired chord is selected by manually moving the string 22 to engage in electric contact with one of the first set of electrically conductive contacts 52, 54, 56, 58 at the top of the neck fingerboard 46. Pressing the string 22 against the top most electrically conductive contact 52 closes the switch associated with this contact and selects the first ("I") chord of the selected key. Pressing the string 22 against the next lower electrically conductive contact 54 closes a switch associated with this contact and selects the forth ("IV") chord of the selected key. Pressing the string 22 against the next lower electrically conductive contact 56 closes the switch associated with this contact and selects the fifth ("V") chord of the selected key. Pressing the string 22 against the bottommost electrically conductive contact 54 of the first set of contacts closes the switch associated with this contact and selects the relative minor sixth chord of the selected key.

In time with the music, the actual note to be played by the instrument 12 is selected by the musician by manually moving the string 22 to contact the electrically conductive contact 66 of the second set of contacts thereby closing the switch associated with this contact, or the electrically conductive contact 64 of the second set of contacts, thereby closing the switch associated with this contact. Manually pressing the string 22 to contact the electrically conductive contact 66 causes the microprocessor 86 to send a binary code signal from its outputs IO-8, IO-9, IO-10, IO-11, IO-12 to the address inputs A0, A1, A2, A3, A4 of the record/playback sound module 88. In the example of the electronic sound producing control circuitry 82 shown in FIG. 5, the sound module is a single chip voice record/playback device ISD 2560/120 provided by Winbond® Electronics Corp. Other equivalent devices could also be used. The sound module 88 selects the root note of the selected chord to be played as long as the string 22 is pressed in engagement with the electrically conductive contact 66 closing the switch associated with the contact. It should be noted that the microprocessor outputs, IO-20, IO-21, IO-22 also respond to the closing of the switch associated with the string 22 contacting the electrically conductive contact 66 to manipulate the "CE" and "PD" inputs of the sound module 88 to start and stop the selected note at the proper time. Pressing the string 22 against the electrically conductive contact 68 of the second set of contacts causes the microprocessor 86 to send a signal to the sound module 88 to produce the fifth note of the selected chord in the same manner discussed above.

When making a chord change, pressing the string 22 three times in rhythmic procession against the electrically conductive contact 64 of the second set of contacts controls the microprocessor 86 to send signals to the sound module 88 that result in the sound module producing an appropriate musical segue between the two chords.

Pressing the string 22 to contact the electrically conductive contact 62 of the second set of contacts closes the switch associated with this contact and causes the microprocessor 86 to send signals to the sound module 88 to produce notes one full step higher than those normally chosen by the switches associated with the electrically conductive contacts. This accommodates a one-step mid-song key change. Pressing the string 22 a second time into contact with the electrically conductive contact 62 of the second set of contacts closes a switch associated with this contact a second time which returns the electronic sound producing control circuitry 82 to its normal operation.

An output 94 of the sound module 88 transmits an analog sound output signal for input to an external amplifier/speaker system (not shown).

An input 98 of the sound module 88 provides a connection to a separate source of appropriate recordable sounds that are loaded into the sound module 88 in preparation for use of the instrument 12.

Figure 7:
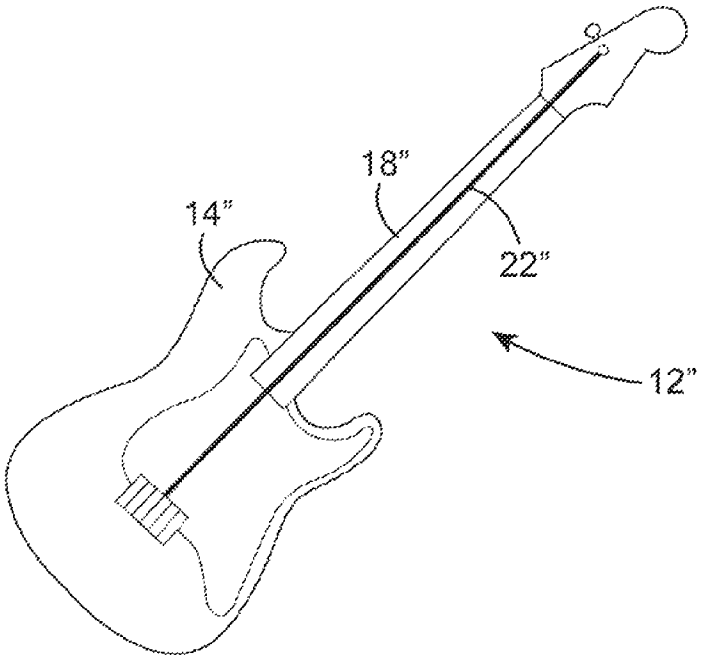
FIG. 7 is a guitar bass embodiment of the instrument.
Figure 6:
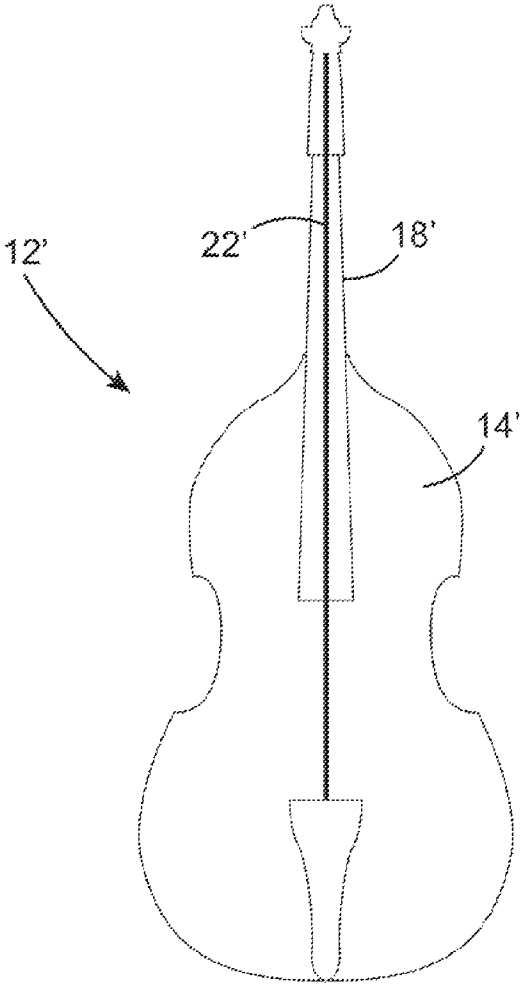
FIG. 6 is a string bass embodiment of the instrument.

Although the electronic bass musical instrument of the invention has been described by referring to a specific embodiment of the invention, it should be understood that modifications and variations of the invention could be made without departing from the intended scope of the appended claims. For example, the above described construction and operation of the instrument 12 could be incorporated into the construction of a conventional stringed bass, such as that shown in FIG. 6, or in a stringed guitar bass such as that shown in FIG. 7. In the embodiment of the electronic bass musical instrument 12' shown in FIG. 6 the body of the base 14' would function as the support of the instrument, with the neck 18' extending from the support 14' and a single string 22' extending from a distal end of the neck across the first and second sets of electrically conductive contacts to the proximal end of the string secured to the bass body. The electronic sound producing circuitry would be contained in the bass body. In the embodiment of the electronic bass musical instrument 12" shown in FIG. 7, the bass guitar body 14" would function as the support of the instrument with the neck 18" extending from the support 14" and the single string 22" extending from a distal end of the neck 18" across the first and second sets of electrically conductive contacts to a proximal end of the string secured to the support body 14". In this embodiment of the instrument the electronic sound producing control circuitry would be contained in the support body 14".

What is claimed:

1. An electronic musical instrument comprising:

a neck having a length with opposite proximal and distal ends;

a plurality of manually operated electric sensors on the neck, the plurality of sensors being arranged at spaced positions along one side of the neck length between the neck proximal and distal ends;

electronic sounds producing control circuitry of the instrument communicating electrically with each sensor of the plurality of sensors;

a string extending over each sensor of the plurality of sensors;

each sensor of the plurality of sensors comprising an electrically conductive contact on the neck; and the string being the only string on the instrument, the string being an electrically conductive string and being manually movable to engage with the electrically conductive contact of each sensor and thereby operatively embodying a manually operated switch at each sensor.

2. The instrument of claim 1, further comprising:

a plurality of isolating frets on the neck with at least one fret of the plurality of frets being positioned between adjacent sensors of the plurality of sensors.

3. The instrument of claim 1, further comprising:

a support connected to the neck proximal end with the neck length extending from the support to the neck distal end; and, the string proximal end being connected to the support and the string distal end being connected to the neck adjacent the neck distal end.

4. The instrument of claim 1, further comprising:

a support connected to the neck proximal end with the neck length extending from the support to the neck distal end, the support comprising a washtub.

5. The instrument of claim 1, further comprising:

a support connected to the neck proximal end with the neck length extending from the support to the neck distal end, the support having a configuration of a guitar body.

6. The instrument of claim 1, further comprising:

a support connected to the neck proximal end with the neck length extending from the support to the neck distal end, the support having a configuration of a string bass body.

7. An electronic musical instrument comprising:

a neck having a length with opposite proximal and distal ends;

an electrically conductive contact on the neck;

an electrically conductive string having a length with opposite proximal and distal ends, the electrically conductive string being the only string on the instrument, the string length extending along the neck length and over the electrically conductive contact on the neck, the string being manually moveable to engage with the electrically conductive contact on the neck and thereby close an electric circuit between the string and the electrically conductive contact.

8. The instrument of claim 7, further comprising:

the electrically conductive contact being one of a plurality of electrically conductive contacts on the neck, the plurality of electrically conductive contacts being arranged on one side of and at spaced positions along the neck length.

9. The instrument of claim 8, further comprising:

electronic sound producing control circuitry communicating electronically with the electrically conductive string and each of the electrically conductive contacts.

10. The instrument of claim 8, further comprising:

the electrically conductive string extending over each electrically conductive contact of the plurality of electrically conductive contacts.

11. The instrument of claim 8, further comprising:

a plurality of isolating frets on the neck with at least one fret of the plurality of frets being positioned between adjacent electrically conductive contacts of the plurality of electrically conductive contacts.

12. The instrument of claim 7, further comprising:

a support connected to the neck proximal end with the neck length extending from the support to the neck distal end; and the electrically conductive string proximal end being connected to the support and the electrically conductive string distal end being connected to the neck adjacent to the neck distal end.

13. The instrument of claim 7, further comprising:

a support connected to the neck proximal end with the neck extending from the support to the neck distal end, the support comprising a washtub.

14. The instrument of claim 7, further comprising:

a support connected to the neck proximal end with the neck length extending from the support to the neck distal end, the support having a configuration of a guitar body.

15. An electronic bass musical instrument comprising:

a support;

a neck having a length with opposite proximal and distal ends, the neck proximal end being connected to the support with the neck length extending from the support to the neck distal end;

an electrically conductive contact on the neck between the neck proximal end and the neck distal end;

an electrically conductive string having a length with opposite proximal and distal ends, the electrically conductive string being the only string on the instrument, the string proximal end being connected to the support and the string distal end being connected to the neck adjacent to the neck distal end with the string length extending along the neck and over the electrically conductive contact, the string being manually moveable to engage with the electrically conductive contact on the neck and thereby close an electric circuit between the string and the electrically conductive contact; and, electronic sound producing control circuitry communicating electronically with the electrically conductive string and the electrically conductive contact.

16. The instrument of claim 15, further comprising:

the electronically conductive contact being one of a plurality of electrically conductive contacts arranged in spaced positions along one side of the neck length; and, the electronic sound producing control circuitry communicating electronically with the electrically conductive string and each of the electrically conductive contacts.

* * * * *